US008240064B2

(12) United States Patent
Steffens

(10) Patent No.: US 8,240,064 B2
(45) Date of Patent: Aug. 14, 2012

(54) DRYER WITH RECIRCULATED AIR PROPORTION AND METHOD FOR ITS OPERATION

(75) Inventor: Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 350 days.

(21) Appl. No.: 12/624,532

(22) Filed: Nov. 24, 2009

(65) Prior Publication Data

US 2010/0146811 A1 Jun. 17, 2010

(30) Foreign Application Priority Data

Dec. 11, 2008 (DE) ..... 10 2008 054 548

(51) Int. Cl.
*F26B 3/00* (2006.01)

(52) U.S. Cl. ..... 34/480; 34/603; 34/210; 392/385; 96/153

(58) Field of Classification Search ..... 34/381, 34/480, 524, 90, 105, 210, 603, 604; 392/384, 392/385; 96/153
See application file for complete search history.

(56) References Cited

U.S. PATENT DOCUMENTS

| | | | | |
|---|---|---|---|---|
| 2,424,737 | A * | 7/1947 | Broglie | 34/82 |
| 2,704,896 | A * | 3/1955 | Hopkins | 34/76 |
| 3,032,887 | A * | 5/1962 | Whyte et al. | 34/524 |
| 3,081,555 | A * | 3/1963 | Stratman | 34/79 |
| 3,681,947 | A * | 8/1972 | Cowan | 68/18 F |
| 3,727,435 | A * | 4/1973 | Menk | 68/18 F |
| 3,748,746 | A * | 7/1973 | Robandt | 34/82 |
| 3,882,613 | A * | 5/1975 | Wilson | 34/552 |
| 4,103,397 | A * | 8/1978 | Jackson | 19/66 CC |
| 4,434,564 | A * | 3/1984 | Braggins, Jr. | 34/86 |
| 4,700,492 | A * | 10/1987 | Werner et al. | 34/403 |
| 4,848,105 | A * | 7/1989 | O'Connell et al. | 68/18 F |
| 5,062,219 | A * | 11/1991 | Harris et al. | 34/606 |
| 6,709,499 | B2 | 3/2004 | Moschuetz | |
| 7,055,262 | B2 * | 6/2006 | Goldberg et al. | 34/86 |
| 2004/0206347 | A1 * | 10/2004 | Gallagher | 126/299 E |
| 2007/0107250 | A1 | 5/2007 | Gassmann et al. | |
| 2007/0266587 | A1 * | 11/2007 | Bringewatt et al. | 34/134 |
| 2009/0229141 | A1 | 9/2009 | Nawrot et al. | |
| 2010/0132216 | A1 * | 6/2010 | Krausch et al. | 34/443 |
| 2010/0146811 | A1 * | 6/2010 | Steffens | 34/480 |

FOREIGN PATENT DOCUMENTS

| | | | |
|---|---|---|---|
| DE | 3000865 | A1 | 7/1981 |
| DE | 8605014 | U1 | 6/1986 |
| DE | 3600058 | A1 * | 7/1987 |
| DE | 10302864 | A1 | 8/2004 |
| EP | 0468573 | A1 | 1/1992 |
| EP | 0648885 | A1 | 4/1995 |
| EP | 1098028 | B1 | 5/2001 |
| EP | 2177661 | A1 * | 4/2010 |
| WO | 2008/110449 | A1 | 9/2008 |

* cited by examiner

*Primary Examiner* — Stephen M. Gravini
(74) *Attorney, Agent, or Firm* — James E. Howard; Andre Pallapies

(57) ABSTRACT

A dryer includes a drying chamber for the articles to be dried, a supply air duct, a process air duct, a heater in the process air duct for heating process air, a blower that guides the heated process air over the articles to be dried, an exhaust air duct that directs exhaust air to an exhaust air outlet, and an internally and/or externally cleanable lint filter in a recirculated air duct that splits at a branching-off point from the process air duct to the heater and the exhaust air duct which leads to the exhaust air outlet, and wherein the recirculated air duct joins the supply air duct upstream of the heater.

14 Claims, 3 Drawing Sheets

DRYER WITH RECIRCULATED AIR PROPORTION AND METHOD FOR ITS OPERATION

BACKGROUND OF THE INVENTION

The invention relates to a dryer with recirculated air proportion as well as to a preferred method for its operation.

With regard to the prior art, reference is made to the publication WO 2008/110449 A1, whose disclosure is to be incorporated by reference in its entirety in the present disclosure.

A clothes tumble dryer is generally operated as a vented or condenser dryer. Condenser dryers, whose principle of operation is based on the condensation of the moisture evaporated from the laundry by means of warm process air, require no vent hose and enable energy to be recovered from the heated process air, through use of a heat pump for example. The condensate accumulating in the condenser dryer is collected and either pumped away or disposed of by manual emptying of a collecting vessel. In the case of a vented dryer, on the other hand, the air laden with moisture after passing through a laundry drum is generally ducted out of the dryer. Generally no heat recovery takes place during this process.

Vented dryers having heat recovery are known, however. Thus, for example, the document DE 30 00 865 A1 describes a tumble dryer incorporating heat recovery. The tumble dryer consists of a moving tub which accommodates the laundry and into which there discharges a stream of supply air heated by a heating element, while the moist warm air is ducted as exhaust air by way of an outlet. Disposed in the supply air stream ahead of the heating element is a heat exchanger through which flows the moist warm air from the container.

The energy efficiency of a vented dryer can also be improved by means of an air recirculation system. With this arrangement a fraction of the process air laden with moisture from the laundry in the drying chamber is returned to the drying process by way of the heater. A disadvantage here, however, is that a great deal of the lint originating from the laundry in the drying chamber can reach the heater. This can lead to the buildup of lint in the downstream airways including the heater. The risk of burn marks and the fire hazard are also increased, since the lint may ignite on the heater and find its way into the laundry in the drying chamber. It is likewise disadvantageous that substantially more condensate is produced in the typically long exhaust air duct and more lint is also deposited in the exhaust air duct due to the higher relative humidity of the exhaust air and the process-dependent low volume of the externally ducted process air stream which is routed for example into the room where the appliance is installed.

EP 0 468 573 A1 describes a device for cleaning a heat exchanger of a condenser apparatus in a clothes dryer. In this arrangement the heat exchanger, consisting of a plurality of fins disposed parallel to one another, can be cleaned on its side lying opposite a condensate water tray by means of a cleaning device. The latter contains a reciprocatingly moving, comb-like brush or bristle arrangement to which condensate water contained in the condensate water tray is supplied in addition.

DE 86 05 014 U1 describes a device for automatically cleaning a lint filter which is arranged in a filter housing and retains the lint contained in an air stream directed through the filter housing and the lint filter, wherein the lint filter is movably mounted, there is provided in the filter housing an opening which can be closed by means of a movable cover, the lint filter can be moved into said opening, and devices are present which generate a cleaning air stream through the lint filter from the rear.

DE 10 2005 054 684 A1 describes a device for drying laundry by means of an air stream, the device comprising a drum and a ducting system to direct the current of air, the ducting system having a section which is arranged on the downstream side of the drum, in which the air stream is directed in a downward direction and in which there is disposed a filter for trapping lint from the air stream and associated with said filter is a scraper for scraping off lint trapped by the filter.

DE 694 18 133 T2 relates to a device for cleaning the filter of a hot air stream drying circuit of an electric household appliance comprising a drying compartment. The cleaning device comprises fixed cleaning elements, preferably nozzles, through which water is channeled and which direct a jet of water onto the filter in the opposite direction to the air current flowing through the filter at least during a section of at least one operating phase of the appliance.

EP 1 098 028 B1 relates to a laundry dryer having a self-cleaning lint filter in a drying air duct which has a device for reducing or closing the cross-section of the drying air duct and for generating a jet of air for blowing off lint from the lint filter when the drying air blower is switched on and a device for removing blown-off lint.

DE 100 29 428 A1 describes an air-circulating household appliance comprising a removable and washable filter disposed in the air stream, the filter consisting of a flexible fiber material and being embodied in such a way that it can bind and/or decompose odorous substances.

DE 103 02 864 A1 describes a laundry dryer, in particular a condenser dryer, comprising a rotatably mounted laundry drum which has at least one air inlet and at least one air outlet, and a fan for feeding air into the laundry drum, wherein a switchover device is present for switching the air stream through the laundry drum between recirculated air and exhaust air operation. A filter for trapping lint or other contaminants that are carried out from the laundry drum with the exhaust air can additionally be arranged at the air outlet from the laundry drum.

BRIEF SUMMARY OF THE INVENTION

An object of the present invention is to provide a vented dryer having high energy efficiency which uses a proportion of recirculated air and in which the above-described disadvantages caused by lint originating from the drying chamber can be overcome.

The subject matter of an exemplary embodiment of the invention is therefore a dryer including a drying chamber for the articles to be dried, a supply air duct, a process air duct in which there is disposed a heater for heating the process air and the heated process air can be guided by means of a blower over the articles to be dried and directed via an exhaust air duct to an exhaust air outlet, wherein the process air duct splits at a branching-off point into a recirculated air duct to the heater and the exhaust air duct which leads to the exhaust air outlet, and wherein an internally and/or externally cleanable lint filter is disposed in the recirculated air duct and the recirculated air duct joins the supply air duct upstream of the heater.

The lint filter is preferably disposed at the branching-off point.

In a preferred embodiment variant of the invention an internally cleanable lint filter is provided with a cleaning device, the cleaning device preferably including a scraper device and/or a rinsing device.

The rinsing device preferably includes a reservoir for rinsing liquid and a rinse line. In this embodiment variant of the dryer according to the invention rinsing liquid from the reservoir can be used for cleaning the lint filter, lint adhering to the lint filter being rinsed off with the aid of the rinsing liquid. The rinsing liquid containing lint can then generally flow through a preferably closable opening contained in the process air duct ("discharge outlet") into a collecting vessel for the used rinsing liquid. The collecting vessel is preferably a condensate tray or is connected to a condensate tray, possibly via a rinsing water line.

Suitable in particular as a reservoir for rinsing liquid is a condensate container or a part of a condensate container. Preferably, the reservoir can accommodate condensate accumulating in a condensate tray of a condenser dryer. In this way it is possible without great additional overhead in terms of apparatus, essentially using only a condensate pump and condensate tray usually present in any case in a condenser dryer, to perform cleaning of the lint filter in the recirculated air duct. The rinsing liquid can thus contain or consist of condensate. If necessary cleaning agents can be added to the rinsing liquid.

In addition to a rinsing liquid or alternatively thereto the rinsing device can use process air. When process air is used in a rinsing device, the lint filter is preferably impinged upon by process air in a way which enables lint adhering to the lint filter to be detached. In a preferred embodiment variant the rinsing device, when using process air, has a suitably shaped air ducting part for targeted application of process air from the process air duct onto the lint filter. In this case the guiding of the process air is generally controlled in such a way that a removal process for detaching the lint adhering to the lint filter is assisted.

In a particularly preferred embodiment variant of the invention the cleaning device includes a scraper device. The scraper device generally consists of a scraper and a mechanism for automatic or manual actuation of the scraper. Said mechanism preferably comprises a magnetic or thermal actuator. In the case of a magnetic actuator the scraper is actuated by means of an electrically triggered magnet, generally in conjunction with a return spring. In the case of a thermal actuator the scraper is actuated for example due to the expansion of a melting wax.

Upon being actuated the scraper generally slides along the surface of the lint filter and scrapes off lint adhering thereto.

The lint is generally dry in the recirculated air duct, so the embodiment variant comprising a scraper device is particularly preferred.

The externally cleanable lint filter can generally be removed manually from the dryer for cleaning.

In addition to the internally and/or externally cleanable lint filter disposed in the recirculated air duct, the dryer according to the invention usually also has a lint trap which is preferably located in the process air duct between the drying chamber and the branching-off point. Said lint trap serves in particular for trapping coarser lint particles. Generally, therefore, the lint trap has larger openings than the lint filter.

The dryer according to the invention preferably includes at least one heat exchanger. The at least one heat exchanger comprises in particular a heat sink and a heat source of a heat pump, the heat sink in this arrangement preferably being in contact with the exhaust air duct.

A heat pump is known in manifold embodiments and can use various physical and chemical effects to pump heat that is absorbed into a heat sink by means of a suitable heat transfer device to a heat source, where it is released again, usually at a higher temperature level than in the case of the heat sink. Thus, a heat pump is known which exploits the Peltier effect and in which the heat transfer device consists of an arrangement of Peltier elements. Also known is a heat pump which exploits adsorption or absorption as well as in each case corresponding desorption between suitable agents. A regenerative gas cycle can also be used to implement a heat pump. Best known in connection with a laundry dryer is the compressor heat pump, which exploits the cyclic evaporation and condensation of a cooling agent circulated in a closed circuit. The circuit is the heat transfer device in this case. In a dryer equipped with such a heat pump, the warm, moisture-laden process air is essentially cooled in the heat pump's evaporator, which forms the heat sink and where the transferred heat is used to evaporate a cooling agent used in the heat pump circuit. The cooling agent of the heat pump evaporated due to the heating process is fed via a compressor to the heat pump's condenser, which forms the heat source and where heat is released due to the condensation of the gaseous cooling agent, said heat then being used to heat the process air or supply air prior to entry into the drying chamber. In terms of the interaction with the process air or supply air, these statements apply to the heat sink and heat source of any heat pump.

According to an exemplary embodiment of the invention the heat being released in the heat source can be used in the supply air duct for heating supply air or, after the supply air duct and recirculated air duct are joined, for heating the combined supply air and recirculated air.

Alternatively or in addition hereto, the dryer according to an exemplary embodiment of the invention can advantageously have an air-to-air heat exchanger as heat exchanger.

In this case the moist, hot process air from the drying chamber is preferably used to heat supply air which is then fed to the drying chamber. In such an arrangement the exhaust air duct and the supply air duct preferably intersect in the air-to-air heat exchanger.

In the dryer according to an exemplary embodiment of the invention a heat pump and an air-to-air-heat exchanger can also be used simultaneously. For example, an air-to-air-heat exchanger can be disposed in the exhaust air duct between the branching-off point and the evaporator of the heat pump.

The cleaning of the lint filter can be initiated by a user of the dryer or automatically.

For example, a need to clean a lint filter can be determined in a dryer in a per se known manner and said cleaning requirement communicated to a user of the dryer by means of a visual and/or acoustic indicator device on the dryer. The user can then remove the externally cleanable lint filter manually by withdrawing it and clean it of adhering lint outside of the dryer for example by rinsing with water. In the case of an internally cleanable lint filter, on the other hand, the user can initiate cleaning of the lint filter by means of a cleaning device described above.

Alternatively, after a need to clean a lint filter has been established, an above-described internal cleaning of the lint filter to remove adhering lint can be initiated automatically, generally with the aid of a control device of the dryer.

According to an exemplary embodiment of the invention it can, however, also be provided that a cleaning requirement is not established explicitly, but rather that after a certain period of usage of the dryer a user is prompted to clean the lint filter or that the internal cleaning of the lint filter is carried out automatically with the aid of the control device.

Finally it can be provided that cleaning of the lint filter is performed after each completed drying process.

To allow better control of the proportions of recirculated air and exhaust air in the dryer according to the invention, there is preferably disposed in the recirculated air duct a first controllable closing device, for example a damper, which can be fully or partially opened or closed. It is likewise preferred that a second controllable closing device is disposed in the supply air duct.

The recirculated air duct is preferably embodied in such a way that it permits approximately 30 vol. % to approximately 50 vol. % of a process air stream in the process air duct to branch off after exiting the drying chamber.

An exemplary embodiment of the invention is also a method for operating a dryer having a drying chamber for the articles to be dried, a supply air duct, a process air duct in which there is disposed a heater for heating the process air and the heated process air can be guided by means of a blower over the articles to be dried and directed via an exhaust air duct to the exhaust air outlet, wherein the process air duct splits at a branching-off point into a recirculated air duct to the heater and an exhaust air duct which leads to the exhaust air outlet, and wherein an internally and/or externally cleanable lint filter is disposed in the recirculated air duct and the recirculated air duct rejoins the supply air duct upstream of the heater. In the method the cleanable lint filter is cleaned by means of a cleaning device.

In the method according to an exemplary embodiment of the invention the lint filter is preferably cleaned by means of a cleaning device comprising a scraper device. In particular, lint contained on the lint filter is advantageously scraped off by means of the scraper device and conveyed through the exhaust air duct by means of the process air. It is quite particularly preferred for the lint to be conveyed through the exhaust air duct via the exhaust air outlet into a room where the dryer is installed. This is acceptable in particular because the amount of lint removed when the aforementioned lint filter is used is relatively small.

In a preferred embodiment variant of said method approximately 30 vol. % to approximately 50 vol. % of a process air stream in the process air duct is directed into the recirculated air duct after exiting the drying chamber.

Using a recirculated air duct or conveying the hot, moisture-laden recirculated air through the recirculated air duct to the heater generally causes the air temperature upstream of the heater to rise. Owing to the increased air stream over the heater, however, the drum entry temperature can remain in the permissible range. In order to set a desired drum entry temperature or drum exit temperature, the air flow of the exhaust air, the recirculated air and/or the supply air can be regulated, for example through use of a first controllable closing device in the recirculated air duct and/or a second controllable closing device in the supply air duct. The first and/or second controllable closing device can be a damper whose position can be changed from a fully open position to a fully closed position.

In particular, in order to accelerate the heating of the process air after the dryer is turned on, the volume of supply air through the second controllable closing device in the supply air duct can be controlled such that the delivery of supply air is stopped and operation takes place using only recirculated air as process air.

According to an exemplary embodiment of the invention it is preferred if exhaust air, supply air and/or cooling agent are in each case carried through the corresponding heat exchangers in a cross flow or counter flow process.

Since the energy required for drying decreases as the degree of dryness of the articles to be dried in the dryer increases, it is beneficial to regulate the heater accordingly, in other words to reduce its heating output as the degree of dryness increases.

The dryer according to an exemplary embodiment of the invention has the advantage that operating reliability is substantially increased while energy efficiency in recirculated air operation is improved. The cleaning of the lint filter can be accomplished in a simple and efficient manner. Furthermore condensate accumulating in the exhaust air duct in embodiment variants can be reduced and lint removal improved.

BRIEF DESCRIPTION OF THE DRAWINGS

Further details of the invention will emerge from the following description of non-restrictive exemplary embodiments of the dryer according to the invention and a method using the dryer. Reference is made therein to FIGS. 1 to 4 of the attached drawing, in which.

DETAILED DESCRIPTION OF EXEMPLARY EMBODIMENTS OF THE PRESENT INVENTION

Figure 1:
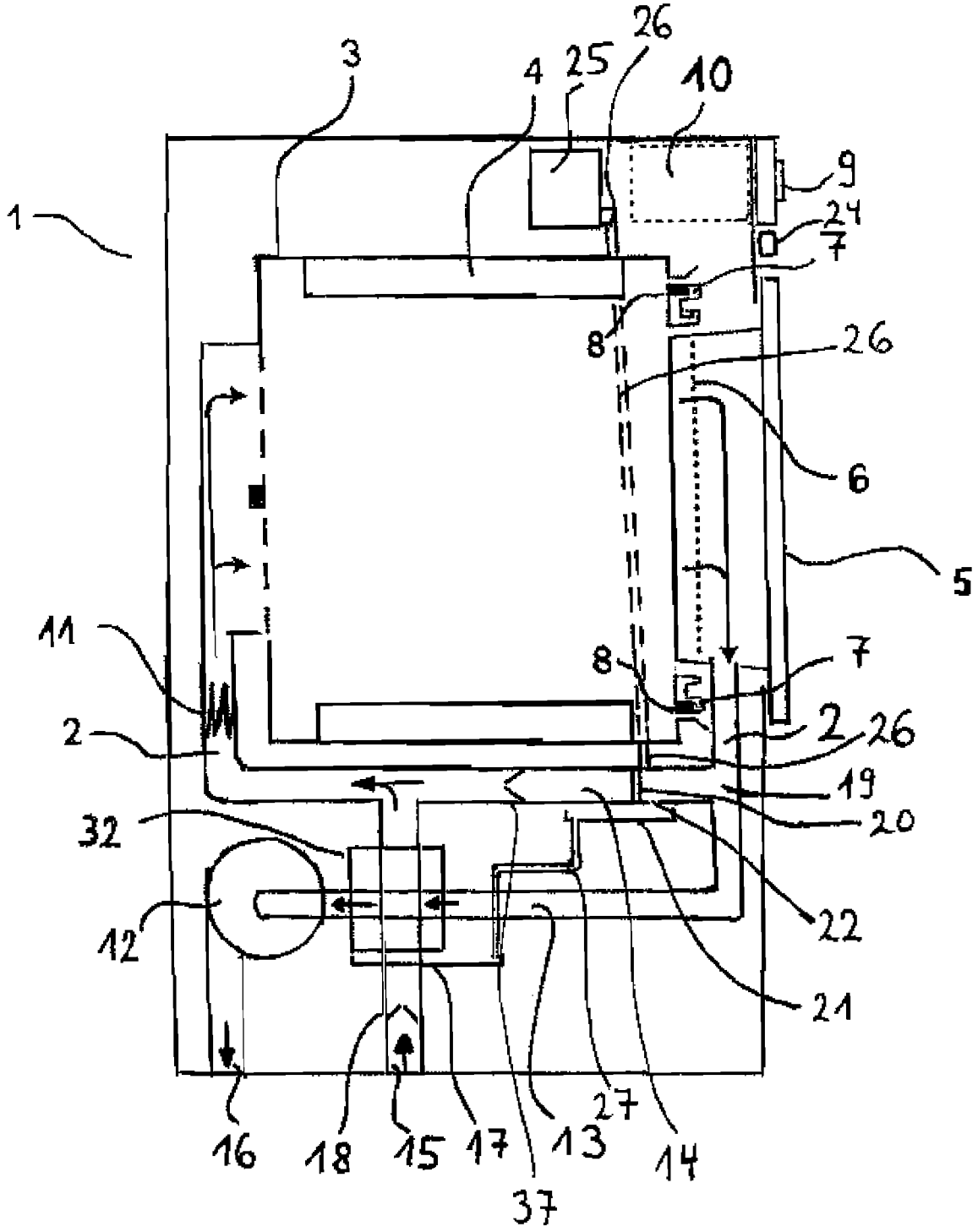
FIG. 1 shows a vertical section through a dryer according to a first exemplary embodiment variant, in which a lint filter is situated in the recirculated air duct and heat recovery takes place by means of an air-to-air heat exchanger.

The dryer 1 shown in FIG. 1 according to a first embodiment variant has a drum that is rotatable about a horizontal axis as a drying chamber 3, fixed inside of which are baffles 4 for moving laundry during a rotation of the drum. Process air is conveyed by means of a blower 12 by way of an electric heater 11, through a drum 3, in a process air duct 2. Ambient air is fed to the process air duct 2 by way of a supply air duct 15 or drawn in by means of the blower 12. After passing through the drum 3 the moist, warm process air is split at a branching-off point 19 into a recirculated air stream in a recirculated air duct 14 and an exhaust air stream in an exhaust air duct 13. Disposed in the exhaust air duct 13 is an air-to-air-heat exchanger 32 in which the process air (in this case: exhaust air) is cooled and, following condensation of the moisture contained therein, is ducted to the exhaust air outlet 16.

A lint filter 20 is disposed in the recirculated air duct at a distance from the branching-off point 19. Starting from a reservoir 25 for rinsing liquid, rinsing liquid can be channeled via a rinse line 26 onto the lint filter 20 for the purpose of cleaning said lint filter 20. In this way lint adhering to the lint filter 20 can be rinsed off The used rinsing liquid containing lint can make its way via a closable discharge outlet 22 in the process air duct into a collecting vessel 21 for the used rinsing liquid, from where, in the embodiment variant shown in FIG. 1, it is ducted further via a rinse water discharge line 27 into a condensate tray 17 which is also used for collecting condensate accumulating in the air-to-air-heat exchanger 32.

In the dryer 1, air heated by the heater 11 is ducted from the rear, i.e. from the side of the drum 3 situated opposite a door 5, into the drum 3 through the latter's perforated base, comes into contact there with the laundry to be dried and flows through the loading opening of the drum 3 to a lint filter 6 inside a door 5 closing the loading opening. The process air stream in the door 5 is then deflected downward. The process air is essentially supplied in an exhaust air duct 13 to an air-to-air heat exchanger 19 in which the warm, moisture-laden process air is cooled and then ducted to the exhaust air outlet 16. The precipitated moisture is collected in a condensate tray 17, from where it can be removed, for example by pumping away into a condensate container, for which purpose the reservoir 25 for rinsing liquid can be used for example.

To provide the cooling, ambient air supplied to the dryer 1 by way of the supply air duct 15 is used in the air-to-air heat exchanger 32. Said supply air is heated by the warm, moisture-laden process air and subsequently heated further by means of the electric heater 11 prior to entering the drum 3. A proportion of the warm, moisture-laden process air exiting the drum 3 is branched off into a recirculated air duct 14 and directed back again into the drum 3 by way of the electric heater 11.

Referring to the embodiment variant shown in FIG. 1, the branched-off process air from the recirculated air duct 14 and the supply air preheated in the air-to-air heat exchanger 32 are combined upstream of the electric heater 11. The air flow in the recirculated air duct 14 can be regulated by means of a first controllable closing device 37 and the supply air stream can be regulated by means of a second controllable closing device 18 (a damper in each case, for example).

Figure 2:
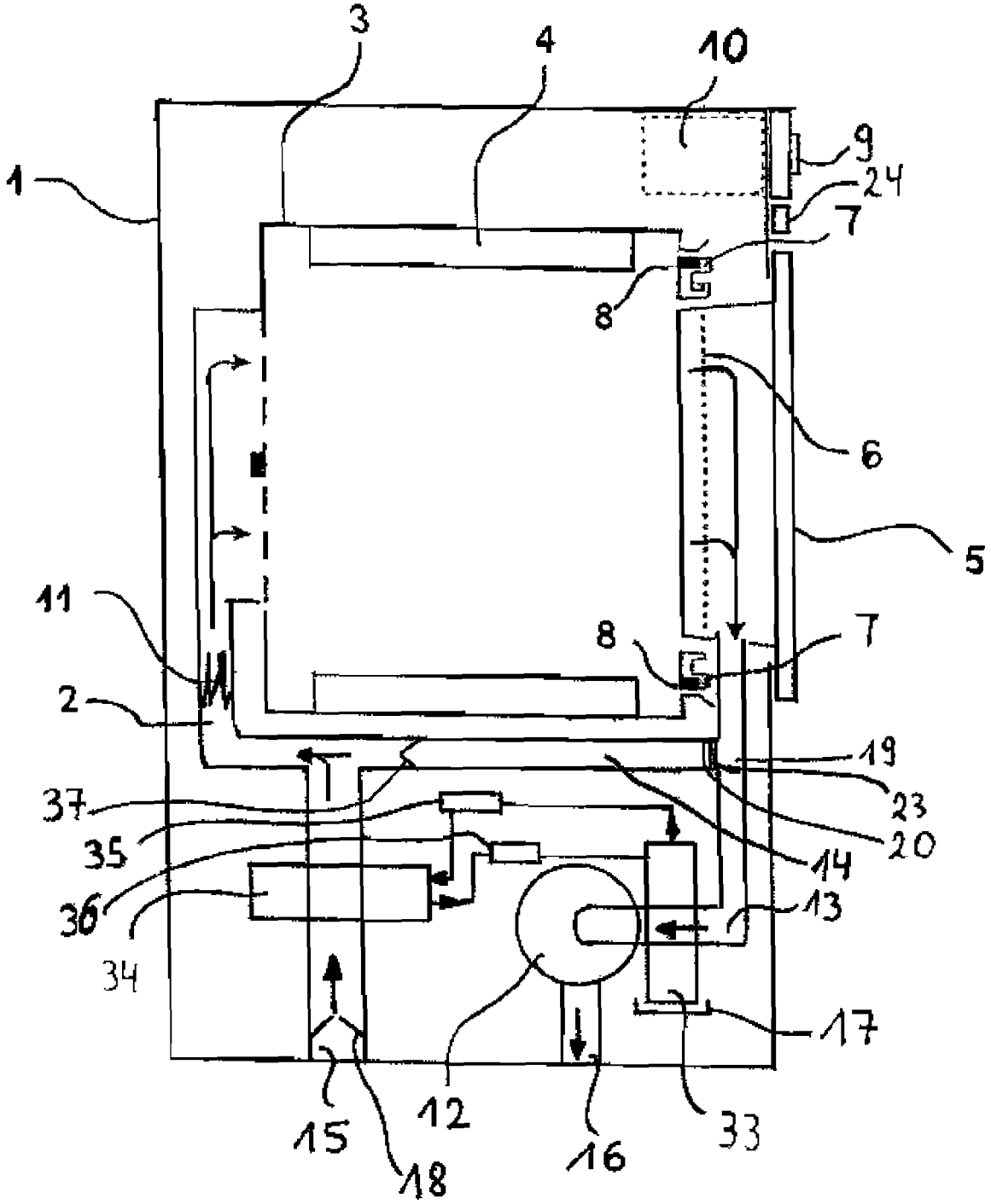
FIG. 2 shows a vertical section through a dryer according to a second exemplary embodiment variant, in which a lint filter is situated in a recirculated air duct at the point at which the recirculated air duct branches off from the process air duct and heat recovery takes place by means of a heat pump.

FIG. 2 shows a vertical section through a dryer according to a second embodiment variant in which the lint filter 20 is disposed in the recirculated air duct 14 at the branching-off point 19 of the recirculated air duct 14 from the process air duct 2 and heat recovery takes place by means of a heat pump. In this case the warm, moisture-laden process air is channeled into the evaporator 33 of a heat pump circuit 33,34,35,36. The evaporator 33 therefore forms the heat sink 33. The cooled process air is conveyed in the exhaust air duct 13 via the exhaust air outlet 16 to the ambient air.

The cooling agent of the heat pump evaporated in the evaporator 33 is directed via a compressor 37 to the condenser 34. In the condenser 34, which represents the heat source 34, the cooling agent condenses, releasing heat to the process air flowing in the supply air duct 15 in the process. The cooling agent, which is now present in liquid form, is channeled back to the evaporator 33 again via a restrictor 36, thereby closing the cooling agent circuit which in the present case defines the heat transfer device, comprising the compressor 37 and the restrictor 36 as well as the corresponding lines for the cooling agent. A proportion of the warm, moisture-laden process air exiting the drum 3 is branched off into the recirculated air duct 14 and routed back into the drum 3 by way of the heater 11.

In the embodiment variant of FIG. 2 the lint filter 20 is situated at the branching-off point 19 of the recirculated air duct 14 from the process air duct 2. At the lint filter 20 there is arranged a scraper device 23 by means of which cleaning of the lint filter 20 to remove adhering lint takes place automatically or initiated by a user of the dryer. Since the lint filter 20 is located at the branching-off point 19, lint removed from the lint filter 20 can be disposed of by means of the exhaust air in the exhaust air duct 19 via the exhaust air outlet 16.

In the embodiment variants shown in FIG. 1 and FIG. 2 the drum 3 is mounted at the rear base by means of a pivot bearing and at the front by means of a bearing shield 7, the drum 3 resting with a rim on a sliding strip 8 against the bearing shield 7 and thus being held at the front end. The condenser dryer is controlled in each case via a control device 10 which can be regulated by the user by way of a control unit 9. An indicator device 24 can indicate various states of the dryer 1, in particular also a need to clean the lint filter 20 and/or lint trap 6.

Figure 3:
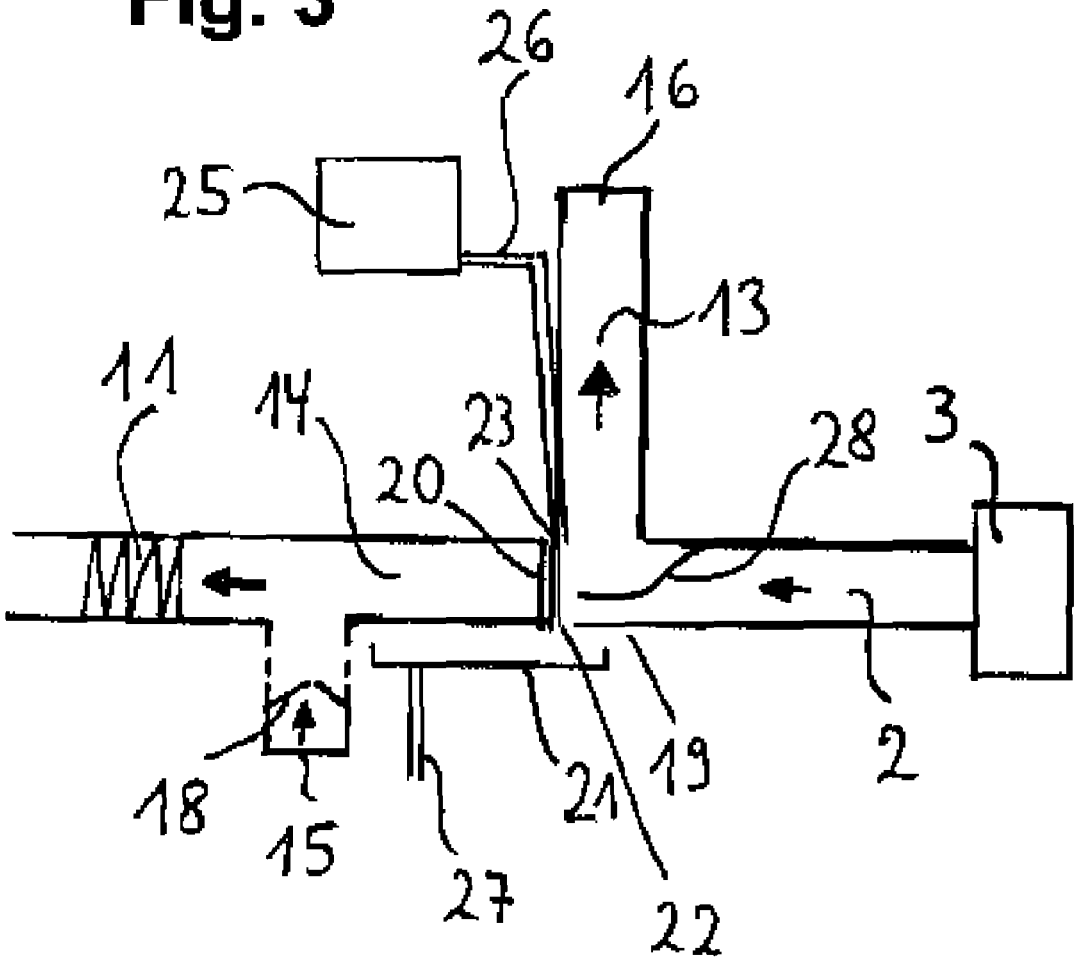
FIG. 3 shows an enlarged section from a dryer in which the area around the lint filter including a cleaning device is depicted in greater detail.

FIG. 3 shows an enlarged section from a dryer in which the area around the lint filter 20 including a scraper device 23 is represented in greater detail. The process air coming from the drum 3 flows partly through the recirculated air duct 14 and partly through the exhaust air duct 13. The lint filter 20, which is provided with a scraper device 23, is situated at the branching-off point 19. From a reservoir 25 for rinsing liquid, rinsing agent, e.g. condensate, is sprayed onto the lint filter 20 via a rinse line 26 in order to flush away lint contained there. In addition hereto the lint filter 20 is cleaned by the scraper device 23. The used rinsing liquid runs via a closable discharge outlet 22 for rinsing liquid into a collecting vessel 21. From the collecting vessel 21 the used rinsing liquid can be disposed of by way of a rinse water discharge line 27 into a waste water system (not shown in FIG. 3) or be conveyed initially into a condensate tray (not shown in FIG. 3), from which it can be pumped into the reservoir 25 for example.

In FIG. 3, reference sign 11 denotes a heater, 15 a supply air inlet, 16 the exhaust air outlet, 18 a second controllable closing device for controlling the supply air, and 28 an air ducting part which is shaped in such a way that it directs the process air coming from the drum 3 in a targeted manner onto the lint filter 20 in order to assist in the releasing of the lint.

Figure 4:
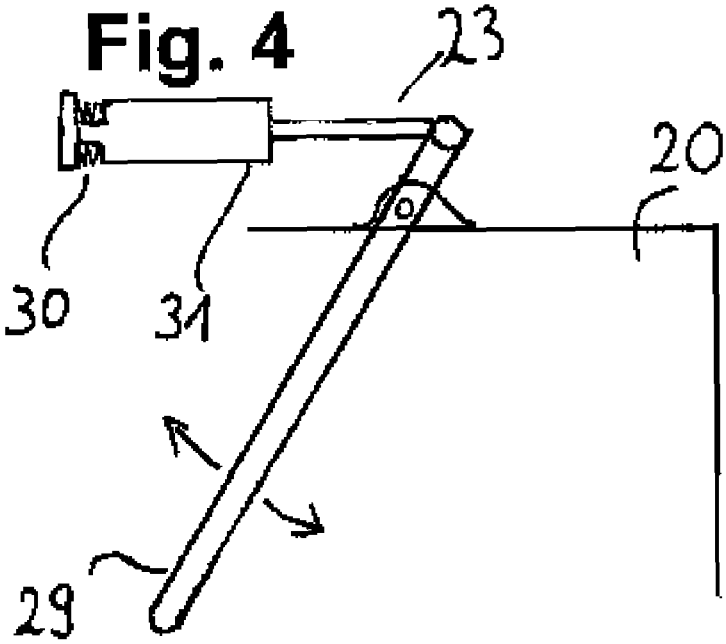
FIG. 4 shows a scraper device as an example of a cleaning device used in the dryer.

FIG. 4 shows a scraper device 23 as an example of a cleaning device used in the dryer. The scraper device 23 comprises a scraper 29 which is moved over a surface of the lint filter 20 by means of a lifting solenoid 31 and a return spring 30.

The invention claimed is:

1. A dryer comprising: a drying chamber for the articles to be dried; a supply air duct; a process air duct; a heater in the process air duct for heating process air; a blower that guides the heated process air over the articles to be dried; an exhaust air duct that directs exhaust air to an exhaust air outlet; and an internally and/or externally cleanable lint filter in a recirculated air duct that splits at a branching-off point from the process air duct to the heater and the exhaust air duct which leads to the exhaust air outlet, and wherein the recirculated air duct joins the supply air duct upstream of the heater.

2. The dryer of claim 1, wherein the lint filter is at the branching-off point.

3. The dryer of claim 1, the lint filter comprises an internally cleanable lint filter that comprises a cleaning device.

4. The dryer of claim 3, wherein the cleaning device comprises a scraper device and/or a rinsing device.

5. The dryer of claim 4, wherein the rinsing device includes a reservoir for rinsing liquid and a rinse line.

6. The dryer of claim 4, wherein the rinsing device comprises an air ducting part for targeted impingement of the lint filter with process air from the process air duct.

7. The dryer of claim 1, wherein lint filter comprises an externally cleanable lint filter that is manually removable from the dryer for cleaning.

8. The dryer of claim 1, wherein the dryer further comprise a heat exchanger.

9. The dryer of claim 8, wherein the heat exchanger includes a heat sink and a heat source of a heat pump.

10. The dryer of claim 9, wherein the heat sink contacts the exhaust air duct.

11. The dryer of claim 8, wherein the heat exchanger comprises an air-to-air-heat exchanger.

12. A method for operating a dryer having a drying chamber for the articles to be dried, a supply air duct, a process air duct, a heater in the process air duct for heating the process air, a blower that guides the heated process air over the articles to be dried, and an exhaust air duct that directs an exhaust air to an exhaust air outlet, wherein the method comprises:

splitting the process air duct at a branching-off point into a recirculated air duct to the heater and the exhaust air duct which leads to the exhaust air outlet;

providing an internally and/or externally cleanable lint filter in the recirculated air duct;

joining the recirculated air duct with the supply air duct upstream of the heater; and cleaning the cleanable lint filter with a cleaning device.

13. The method of claim 12, wherein the cleaning device comprises a scraper device.

14. The method of claim 13, further comprising: scraping lint off the lint filter with a scraper devices; and conveying the lint through the exhaust air duct with the exhaust air.

* * * * *